US011576500B2

(12) United States Patent
De La Vega et al.

(10) Patent No.: US 11,576,500 B2
(45) Date of Patent: Feb. 14, 2023

(54) TEMPERATURE CONTROL PLATE AND SELF-SERVICE SHELF WITH A TEMPERATURE CONTROL PLATE

(71) Applicant: LIDL STIFTUNG & CO. KG, Neckarsulm (DE)

(72) Inventors: Hernan De La Vega, Neckarsulm (DE); Denis Cichuta, Neckarsulm (DE); Christine Wolff, Neckarsulm (DE); Benjamin Zilch, Neckarsulm (DE)

(73) Assignee: LIDL STIFTUNG & CO. KG, Neckarsulm (DE)

( * ) Notice: Subject to any disclaimer, the term of this patent is extended or adjusted under 35 U.S.C. 154(b) by 761 days.

(21) Appl. No.: 16/316,883

(22) PCT Filed: Jul. 4, 2017

(86) PCT No.: PCT/EP2017/066549
§ 371 (c)(1),
(2) Date: Apr. 13, 2020

(87) PCT Pub. No.: WO2018/011004
PCT Pub. Date: Jan. 18, 2018

(65) Prior Publication Data

US 2020/0237117 A1 Jul. 30, 2020

(30) Foreign Application Priority Data

Jul. 13, 2016 (DE) ..... 102016112830.9
Jul. 13, 2016 (DE) ..... 202016103767.0

(51) Int. Cl.
*A47F 3/00* (2006.01)
*A47F 3/02* (2006.01)

(52) U.S. Cl.
CPC ..... *A47F 3/001* (2013.01); *A47F 2003/021* (2013.01)

(58) Field of Classification Search
CPC .. A47F 3/001; A47F 3/06; A47F 3/005; A47F 3/007; A47F 3/0434; A47F 3/0482; A47F 2003/021
See application file for complete search history.

(56) References Cited

U.S. PATENT DOCUMENTS 6,111,224 A 8/2000 Witt
6,259,065 B1 * 7/2001 Hohler ..... A47F 3/001 219/214
7,137,438 B2 * 11/2006 Nomura ..... F25D 25/02 165/64

(Continued)

FOREIGN PATENT DOCUMENTS

DE 3149187 6/1983
DE 202007009975 10/2007

(Continued)

*Primary Examiner* — Patrick D Hawn
(74) *Attorney, Agent, or Firm* — Brooks Kushman P.C.

(57) ABSTRACT

To be able to keep warm or to cool products that are placed on the individual shelves (6) of a dispensing shelf (1), the shelves (6) are embodied as electrically operated temperature-control panels (50), wherein the temperature-control panels (50) as well as particularly the base frame (19) of the dispensing shelf (1) are adjusted to each other in a specific manner.

20 Claims, 8 Drawing Sheets

(56) References Cited

U.S. PATENT DOCUMENTS

| | | | | |
|---|---|---|---|---|
| 7,896,450 | B2 * | 3/2011 | Yamazaki | A47F 3/06 312/114 |
| 8,221,846 | B2 * | 7/2012 | Roche | C03C 17/322 427/385.5 |
| 8,522,675 | B2 * | 9/2013 | Veltrop | A23L 3/005 99/448 |
| 9,086,200 | B2 * | 7/2015 | Aguiar | F21V 15/01 |
| 11,045,018 | B2 * | 6/2021 | Berents | A47F 3/005 |
| 2002/0072323 | A1 * | 6/2002 | Hakemann | F21V 29/60 454/233 |
| 2006/0049726 | A1 * | 3/2006 | Hayase | A47F 3/0486 312/128 |
| 2006/0199495 | A1 * | 9/2006 | Yamaguchi | A47F 3/0491 454/173 |
| 2007/0138167 | A1 | 6/2007 | Friedman et al. | |
| 2007/0247835 | A1 * | 10/2007 | Buelow, II | A47F 3/001 362/125 |
| 2008/0169735 | A1 | 7/2008 | Yamazaki et al. | |
| 2011/0147362 | A1 * | 6/2011 | Van Dorst | A47F 3/001 219/218 |
| 2014/0265758 | A1 * | 9/2014 | Reichert | H05B 3/84 312/138.1 |
| 2014/0292168 | A1 * | 10/2014 | Nevarez | A47J 39/003 312/236 |
| 2015/0230626 | A1 * | 8/2015 | Riaby | A47F 3/0482 312/114 |
| 2019/0040523 | A1 * | 2/2019 | Ganjoo | C23C 14/081 |

FOREIGN PATENT DOCUMENTS

| | | | | |
|---|---|---|---|---|
| DE | 202008001290 | U1 * | 6/2009 | A47F 5/0093 |
| DE | 202014000325 | U1 * | 5/2015 | A47F 5/0025 |
| DE | 202016103424 | | 8/2016 | |
| DE | 202015007690 | | 3/2017 | |
| DE | 202016000375 | U1 * | 4/2017 | A47B 57/04 |
| WO | WO2010002243 | | 1/2010 | |

* cited by examiner

Figure 1A:
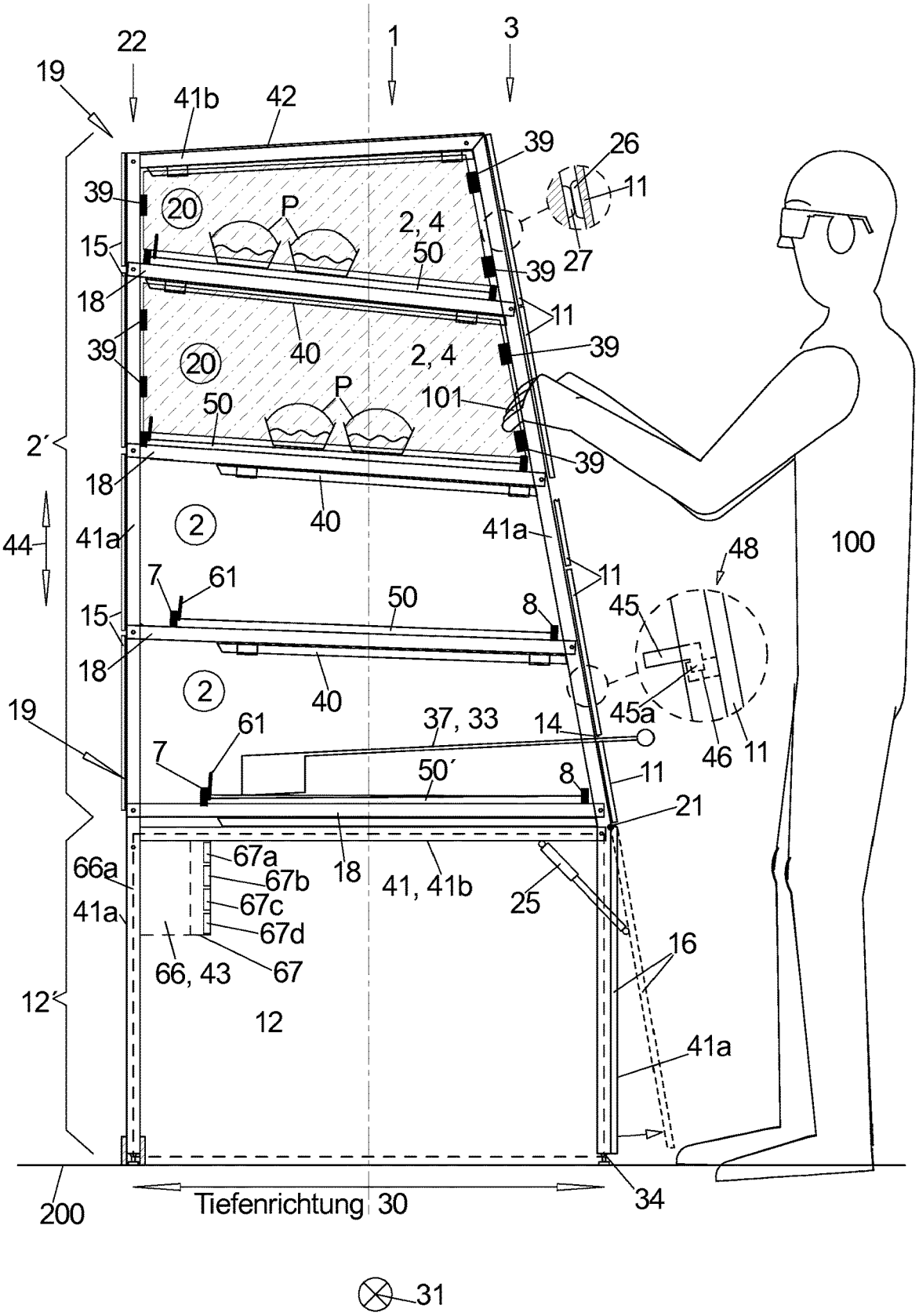
Figure 1B:
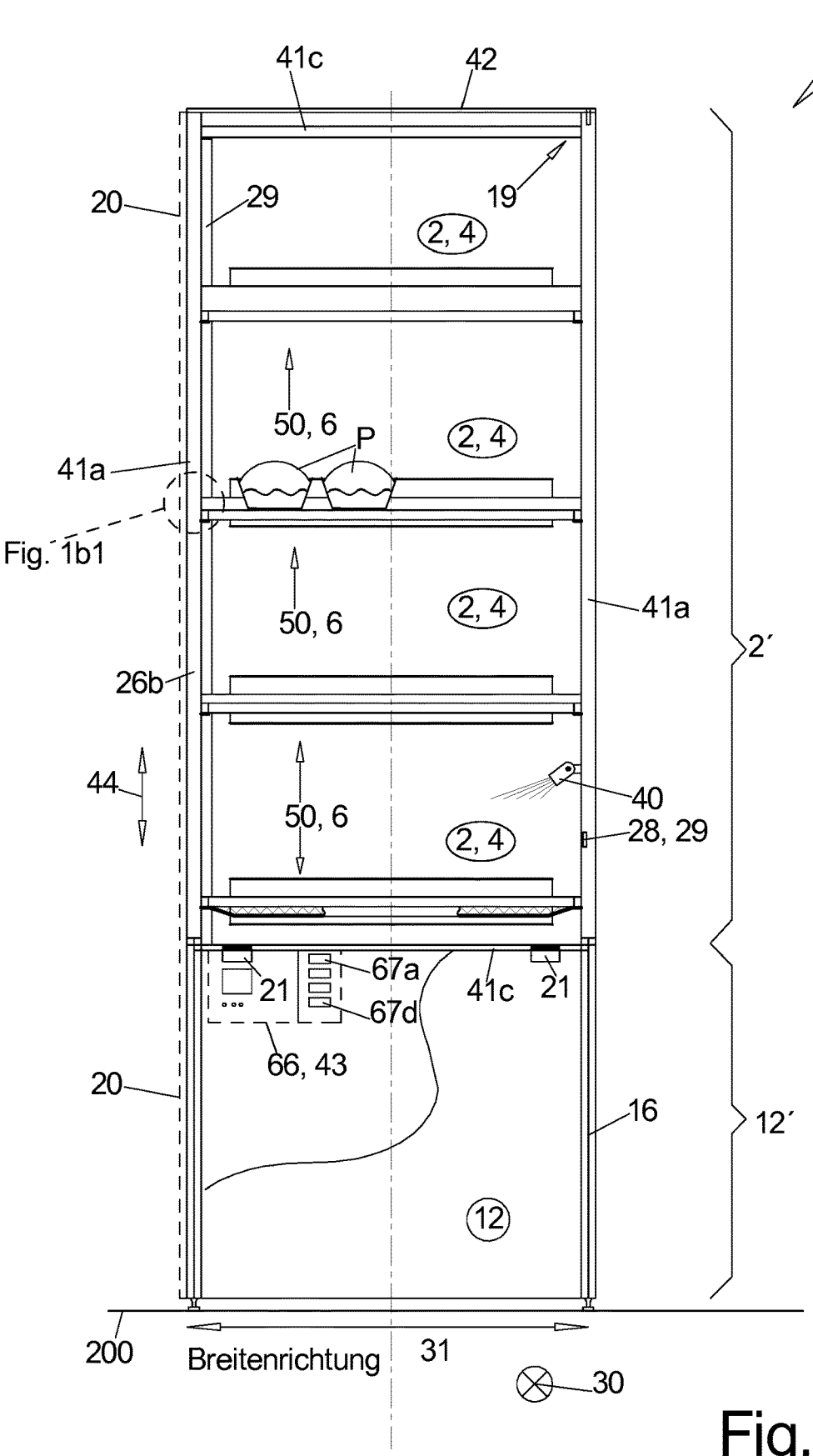

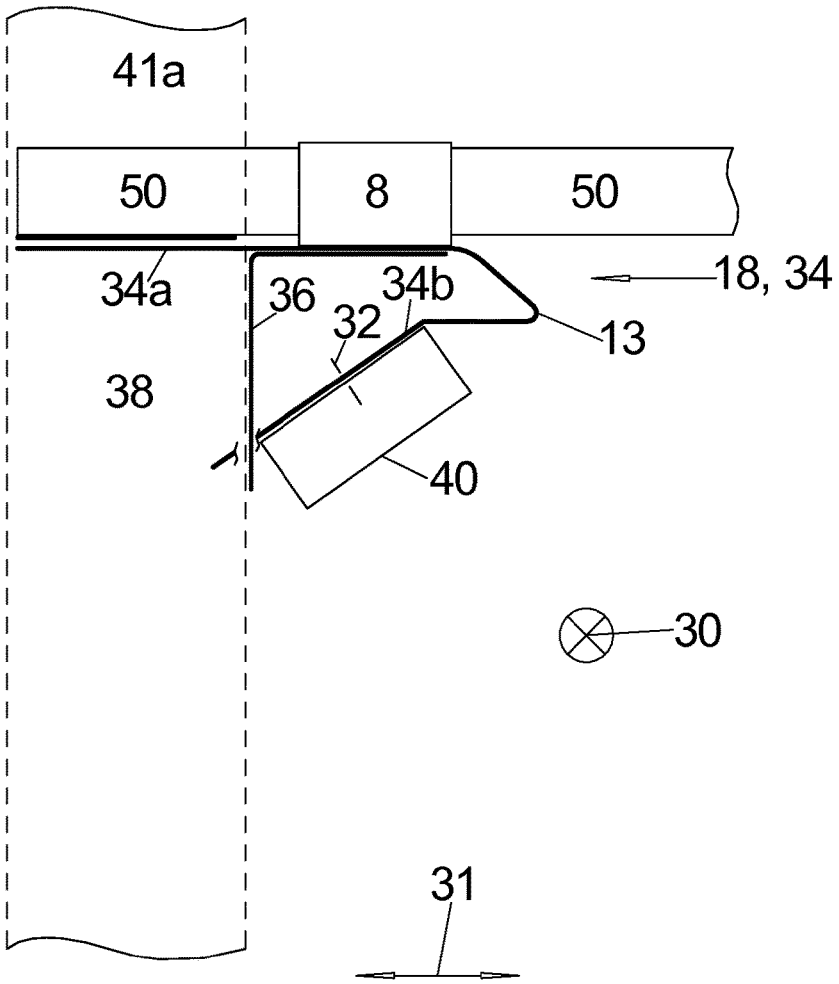
Fig. 1b1

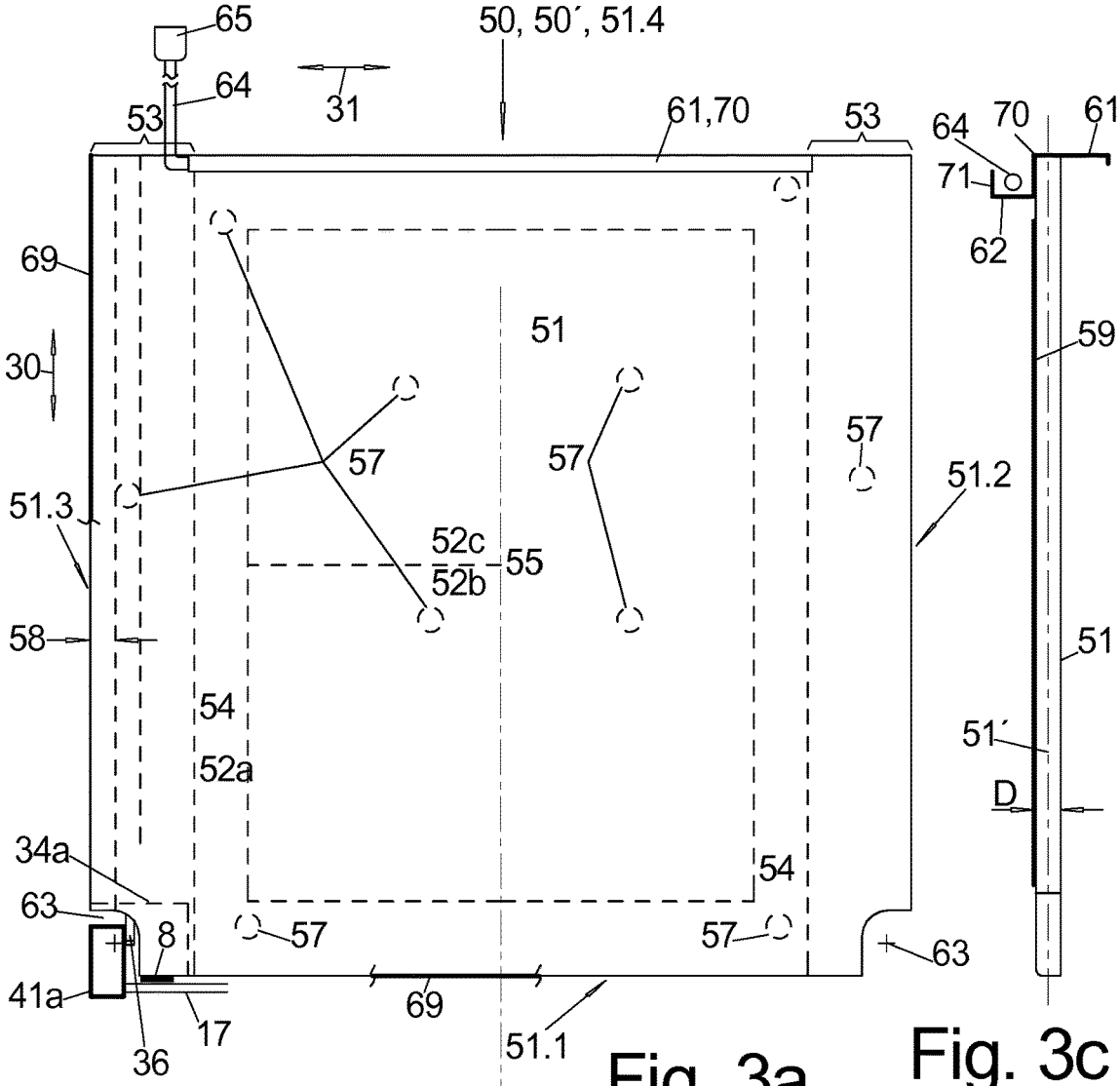
Fig. 3a
Fig. 3c
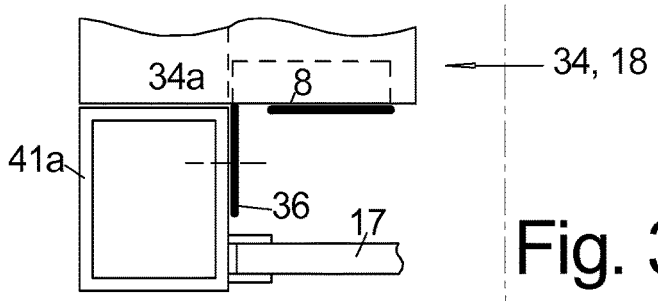
Fig. 3a1
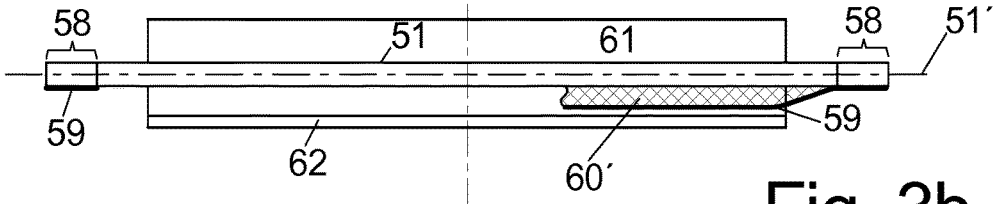
Fig. 3b

TEMPERATURE CONTROL PLATE AND SELF-SERVICE SHELF WITH A TEMPERATURE CONTROL PLATE

I. FIELD OF APPLICATION

The invention relates to a temperature-control panel by means of which foodstuffs that are placed thereon can be temperature-controlled, preferably kept warm or also cooled, mostly in an electrical manner. An electrically operable cooling plate can for example be realized by means of Peltier elements

II. TECHNICAL BACKGROUND

Known in the food service industry as well as in household applications are heating plates that are electrically heated and that can be made of different materials, in most cases of stainless steel, but also of glass.

Moreover, what is known in other fields are heating plates that have a layered structure made of two glass plates and a heating layer that is arranged in between them and that is very thin, in most cases substantially below a millimeter, and that is fixedly connected to the glass panels. The heating layer can consist of an electrically conductive material in the form of a foil, a scrim, a textile material, or a formable mass, e.g. containing particles of electrically conductive materials that are present therein to a sufficient amount. Such heating plates are for example used as heatable window panes in the automotive sector and in other applications.

However, in the present case, the focus is on the use of temperature-control panels, preferably heating plates, in the food self-service field, that is, as a compartment base in a dispenser shelf, so that this heating plate that is used as a shelf can in most cases also be touched by the customer who wishes to take out the product placed thereon, which entails risk of injury:

For, with respect to aspects of microbiology, the products placed thereon must be maintained at least at a core temperature of 65° C. to keep the microbial growth in the product low. However, this in turn means that—depending on the dimensions of the products placed thereon as well as their thermal conductivity—the heating plate has to be heated up to at least 100° C., usually even up to 130° C. With a heating plate of stainless steel having this temperature, touching contact would almost certainly lead to skin burns, and a stainless steel plate would also be disadvantageously strongly deformed at such a temperature.

For these reasons, what was taken recourse to in the past were approaches that were little efficient with respect to use, for example the product was taken out of the heating plate only by an operator, not by the customer him or herself, or the product was seized by using a tool that is held by the customer and extending into the dispensing shelf, wherein the direct access by the customer to the heating plate was prevented by suitable measures.

In addition, the heating plates known so far, in particular if they were made of glass plates, can be regulated only in the form of a single temperature zone, and they have a relatively wide edge that cannot be heated, which, on the one hand, is due to the manufacturing methods, but on the other hand is also provided for the purpose of creating an edge area with such a low temperature that allow for such a heating plate to be easily held with the hand as well as to be fixated in other devices without this other device being heated up strongly.

III. DESCRIPTION OF THE INVENTION a) Technical Objective

Thus, the objective according to the invention consists in providing, on the one hand, a suitable temperature-control panel and, on the other hand, a suitable piece of furniture for self-servicing, in particular a dispenser shelf, with such a temperature-control panel as a shelf.

b) Solution of the Objective

This objective is achieved through the features of claims 1, 4 and 10. Advantageous embodiments follow from the subclaims.

Not known from the state of the art is the use of a temperature-control panel, in particular a heating plate that can be reached by the customer, as a storage surface in a piece of furniture for self-servicing, in particular as a shelf compartment base in a self-service dispensing shelf.

For this purpose, at least one of the main outer surfaces of the temperature-control panel, in particular both main outer surfaces—in the following referred to in short as the top side and the bottom side, since for the purpose of placing objects on the same such a temperature-control panel will be arranged substantially horizontally—are made of a material with a lower thermal conductivity than iron or steel, in particular stainless steel, and namely preferably of glass.

Of course, for this purpose, this material with the low thermal conductivity has to be provided not only at the outer surface but has to extend into the depth of the plate at least so far that the result in a lower thermal conductivity and thus slower heat dissipation to a touching body part, that is, at least up to a depth of half a millimeter, better of 1 mm, better of two or 3 mm.

Especially glass has, on the one hand, a considerably lower thermal conductivity, so that when touched immediate burns can often still be avoided as there is more time to react and to remove the hand from the hot temperature-control panel. Moreover, glass is considerably lighter and quicker to clean than a metal plate, in particular a stainless steel plate.

Further, the use of glass or also most other materials with a lower thermal conductivity than iron or steel has the advantage that these materials are usually not electrically conductive, so that in the event that any damage occurs to the electrically operated temperature-control panel which would lead to the outer surface of the temperature-control panel being electrified, an electric shock upon being touched by a person is avoided.

For this reason, in this use, a heating plate can be heated up and run during operation at up to 100° C., and up to approximately 130° C., which is important for minimizing the germs in the products placed thereon.

Likewise, the air space above the heating plate, for example up to the next shelf that is arranged above it, can be maintained at a predefined target temperature range without problems and exclusively by convection, with its upper limit and lower limit being only maximally 20° C., better maximally 10° C., apart, which can preferably be achieved by the fact that the individual temperature-control areas within the temperature-control panel—as viewed in the top view—can be substantially controlled independently of each other with regard to their temperature by means of a control. Thus, through an edge area that is heated up relatively strongly which, however, is preferably arranged to be separated from the outer edge of the temperature-control panel through a non-heated edge area, a rising warm air curtain is formed that is circumferential in particular in the top view, which avoids the slightly less warm air in the inner area of the air space from flowing out outwards, and in this way avoids a temperature gradient from the inside of the air space to the outside.

The same can in reverse be analogously achieved with a cooling plate, and in this way the active generation of a circumferential flow by means of a fan can be foregone, which creates noise and consumes energy, and also stirs up more durst.

Further, by heating the temperature-control panel up to a very narrow, in particular non-heatable, edge area of maximally 3 cm, better of maximally only 2 cm, better of maximally only 1.5 cm, a very large heated usable area can be achieved on the temperature-control panel, and thus a very good utilization in the use as a shelf.

In this way, it is also possible to maintain the core area of the air space, that is, within the strongly heated, preferably circumferential, edge area, at only slightly above 65° C. in order to obtain and maintain the core temperature of 65° C. in the products, while in conventional heating, such as for example heater lamps, having a pronounced temperature gradient in the air space from the inside to the outside, the temperature has to be set to be much higher in the core area of the air space in order to obtain a core temperature of 65° C. also at the products that are placed at the edge.

Particularly expedient for this use is a temperature-control panel which is preferably electrically operated and can be embodied as a heating plate as well as a cooling plate, with the temperature-control panel being composed of a glass upper plate and a glass lower plate and with a temperature-control layer, in particular a heating layer, being placed in between them, as has already been mentioned above.

In addition, the temperature-control panel—at least on its top side and its front narrow side that is facing towards the customer, or in general in all surface areas that can be reached by the customer—should be free of materials that have a higher thermal conductivity than the material of the top plate and bottom plate, that is, in particular it should have no attachment parts that are made of metal to avoid that these are heated up to the temperature of the glass plates, and thus to avoid that the customer is burned when touching contact occurs.

Preferably, not only one but multiple temperature sensors are provided in a manner distributed across the surface in the temperature-control panel itself to constantly control the temperature of the temperature-control panel and also to be able to inform the control which then can readjust the heating or cooling performance correspondingly—in particular independently of each other inside the individual temperature-control areas.

The control is preferably also capable of switching the temperature-control panels on and/or off at pre-definable points in time, as well as increasing or reducing the target temperature and in particular the heating or cooling performance at pre-definable points in time—in particular separately for the individual temperature-control areas.

Preferably in the strongly temperature-controlled edge area, which is preferably offset inwards from the non-temperature-controlled outermost edge area in the direction towards the center of the temperature-control panel, one or preferably multiple temperature sensors are arranged at a distance from each other, and likewise in the core area that is surrounded by the strongly heated edge area.

Preferably, temperature sensors are also provided in the non-heated edge area.

As far as an edge area is mentioned above, it is preferably respectively a circumferential edge area, but it could also be an edge area on individual sides, for example on the two opposing sides.

Thus, the temperature-control panel has a support area which extends along these side edges on two opposing sides—wherein its extension direction is referred to as the depth direction—and with which the temperature-control panel can be placed on two opposing sides on corresponding supports.

The support area is defined in that it is arranged at the bottom side of the temperature-control panel and has a protective coating, in particular a stainless steel plate, and a thermal insulating layer is preferably present between this protective coating and the temperature-control panel.

These support areas can have the same or a smaller width than the non-heated edge area of the temperature-control panel.

Preferably at its rear edge that extends between the two support areas, the temperature-control panel has an upwardly projecting rear stop to avoid that products placed on the temperature-control panel fall over a rear edge, wherein the rear stop preferably extends across more than 80% of the length of the rear edge in its extension direction.

Preferably, the temperature-control panel has respectively one corner recess in its front two corner areas, in particular a rectangular recess with a rounded inner corner or a recess with an arc-shaped contour, in particular a contour with the shape of a quarter circle. As in most cases a dispensing shelf has a base frame that usually consists of profiles extending along the outer edges, mostly made of metal, the cross section of a front upright profile can respectively be accommodated in these corner recesses, so that the temperature-control panel can extend to the front at this height up to the front edge of the base frame, and can extend laterally up to the outer surfaces of the base frame at this height.

In this way, the non-heated outermost edge area is located for the most part in the area of the thickness and/or of the depth of the upright profiles, so that the area between the four upright profiles is usually almost completely available as a heated surface for the placement of products.

In the transversal direction, the corner recess is as large as or larger than the width of the non-heated outermost edge area, and preferably the corner recess is larger in the transversal direction than the cross section of the front upright profiles in this direction, which has advantages with respect to handling, as will be described later.

It is particularly advantageous if the temperature-control panel has temperature-control areas that can be controlled independently of each other, as viewed in the top view, so that for example also the core area of the temperature-control panel is divided into multiple temperature-control areas, for example when it is not necessary to temperature-control the entire surface of the temperature-control panel due to the number of the stored products, and above all it is of course possible in this manner to heat up a strongly heated edge area to a higher temperature than the less strongly heated core area, with these also representing areas of the temperature-control panel that can be separately controlled with respect to their temperature.

Since as a general rule the temperature-control panel is operated electrically, a cable, at least for the supply of power and preferably in addition for data transmission from the temperature sensors in the temperature-control panel to the control unit, leads away from the actual temperature-control panel and namely preferably out of its rear end. Usually, a plug is located at the free end of the cable, so that the cables of all temperature-control panels that are used in a shelf can respectively be plugged respectively independently of their number into corresponding plug sockets at a plug bar that can be arranged directly at the control unit.

At its bottom side, the temperature-control panel can have a planar insulation, in particular with an outer surface of stainless steel or plastic material, in the case that the radiation of heat downwards is to be minimized in this temperature-control panel, which is for example regularly the case in the lowermost temperature-control panel that is used in a dispensing shelf, whereas with all other levels the downward radiation is also desired, since in this way the air space of the compartments located below them is heated as well.

The top plate and bottom plate, in particular if they consist of glass, usually have the same thickness. However, when used as a heating plate, the top plate is preferably embodied to be thinner than the bottom plate, and when used as a cooling plate, the top plate is preferably embodied to be thicker than the bottom plate.

Based on the example of a heating plate, it will become clear that, for one thing, much less time is needed for heating up the thinner top plate than for heating up the bottom side, and thus the heating plate can be put into operation much faster, and in particular that the heat storage prior to the heat being radiated into the environment becomes less in the top plate in this way, and in addition the heat dissipation via the laterally circumferentially narrower side surfaces is kept low.

To be able to use such a heating plate optimally in a self-service dispensing shelf, such a dispensing shelf is designed in a specific way:

According to the class of the invention, the self-service dispensing shelf is known to have the following features:

On the one hand, a base frame that preferably consist of a frame made of profiles, most often of metal profiles, that extend at least along the edges of the dispensing shelf which preferably has approximately the shape of an upended ashlar, wherein its front surface—at least in the upper area—preferably recedes obliquely upwards and backwards.

Correspondingly, the base frame comprises uprightly positioned, in particular vertically positioned, upright profiles on the one hand, as well as transverse profiles that extend horizontally in the transversal direction in front of the removing person, as well as depth profiles extending in the depth direction, that is, in the direction extending from the front side that is facing towards the removing person to the opposing back side of the dispensing shelf direction.

The dispensing shelf comprises at least one storage space and at least one removal space—wherein the storage space is often at the same time the removal space for the products—, with one or multiple products being directly removable from the storage space inside of which usually a plurality of products is located instead of first moving them from a storage space into which one cannot reach to a separate removal space.

In such a dispensing shelf, multiple storage spaces and/or take-out rooms are often arranged in levels above each other, separated from each other in height by mostly plate-shaped shelves as dividing elements that are arranged in between them, and usually cover the total horizontal cross section of the dispensing shelf at this position.

A temperature-control panel according to the invention or also a simple, non-temperature-controlled bearing shell for the products stored thereon or therein can for example be used as such a shelf. Thus, in such a dispensing shelf, only one, a few, or all shelfs can be configured as—usually electrically operated—temperature-control panels.

These shelves or dividing elements usually rest on support bars that extend in the depth direction and can be accessed by the personnel from the back side, which is mostly the loading side of the shelf.

If a simple bearing shell is used as a shelf and thus as a dividing element between the levels, that is, storage spaces that are arranged above one another, the personnel can exchange an empty bearing shell from the back side for a bearing shell that is filled with products.

If a temperature-control panel, for example a heating plate, is used as a shelf and thus as a dividing element and is arranged on the support bars, it is not taken out of the dispensing shelf for filling it with products because it is connected to a power supply unit for the purpose of being supplied with power and also because it has a much greater weight and higher value than a simple bearing shell made of plastic material, and also because it is more prone to being damaged.

The releasable attachment, that is, an attachment that is releasable in a simple and fast manner and preferably without a tool, of as many components as possible, such as for example also the temperature-control panels, at the base frame is also relevant with respect to hygiene, as all removed components can be cleaned or can also be disinfected more intensively separately, and also the remaining rest of the dispensing shelf, in particular the base frame, can be cleaned particularly thoroughly.

The support bars and thus also the compartment bases themselves are usually arranged so as to be slanted upwards from the front to the back in the depth direction, so that the products placed thereon are presented to be better visible for the removing person. If multiple compartment bases are arranged above each other, their inclination preferably increases from the bottom up, also to provide an improved visibility of the products placed thereon.

As for the design of the front of such dispensing shelfs, there are two possibilities, since the air that is heated up in the air space of a level that is heated or cooled e.g. by a heating plate, for example a storage space, is not supposed to be able to flow unrestricted towards the front—and also not in the other directions—, which would result in a very high energy loss over time:

The front side of a removal space, which can at the same time be a storage space, is either closed—preferably for each individual removal space or only over the height of two removal rooms, but not over all take-out rooms—by a storage front plate that is embodied as a door or a flap, which in most cases is embodied as a translucent storage front pane as, which may for example be made of glass and which the user opens in order to remove a product form the storage space and then closes it again, and which as a general rule closes by itself if it is no longer held open as a result of gravity.

To avoid that the impact of the door or flap is too hard even if it is dropped, a stop damper or a speed limitation device for the dropping is additionally mounted.

The other possibility consists in the front side of each individual storage space being not completely closed by one or two storage front plates or storage front panels which adjoin each other in their height, so that a tool opening remains open in the front side of each storage space, with a tool, in particular the shaft of a tool such as for example a slider or a spoon, extending through it.

The removing person holds the tool at the outer end and with the inner end of the tool then moves the desired product from the substantially closed storage space into a neighboring removal space which is separated by flap that can be swung open and into which the user can reach from the front side and remove the selected product.

The dispensing shelf is dimensioned in such a manner with respect to the positioning and dimensioning of its supports for the compartment bases relative to the dimensions of the temperature-control panel that, instead of a regular compartment base, such as for example a bearing shell for products, the temperature-control panel can be placed on the same supports, in most cases the bearing strips that extend in the depth direction of the shelf.

However, here the dispensing shelf as well as its bearing strips or in general its supports are designed and dimensioned in relation to the dimensions of the temperature-control panel in such a manner that, in the (preferably centrally) inserted state, the temperature-control panel rests on these bearing strips apart from a free lateral edge area of less than respectively 8 mm, better of less than respectively 5 mm, better of less than respectively 2 mm, which respectively remains free on the top side of the bearing strips on the outside on both sides. However, preferably the temperature-control panel extends up to the outer edge of the bearing strips and/or up to the outer edge of the base frame or the upright profiles of the base frame or frame rack, but preferably not beyond the dimensions of the base frame.

Design of the Bearing Strip in the Cross Section

Preferably, these bearing strips are designed in such a manner that each bearing strip at first has a V-profile, which in most cases is formed as a bent sheet metal part, and at the front and rear end of the V-profile respectively a fixation appliance, for example a screw lug by means of which the bearing strip can be attached respectively at a front and a rear upright profile, in particular screwed to the same. For this reason, the fixation appliance is usually a screw lug that is positioned perpendicularly to the one leg of the V-profile, which in the mounted state provides the support surface for a dividing element such as for example the temperature-control panel 50. On the one hand, the other leg of the V-profile, which in the mounted state points in the direction towards the center of the shelf with the tip of its profile shape, so that the V-profile is open towards the outside, has the purpose that a light bar can be attached at the inwards and downwards oriented outer side of this other, lower leg.

The V-profile is open towards the outside and the lower leg extends obliquely, so that contaminations such as for example by crumbs of baked goods are prevented from collecting in the interior as far as possible.

For the same reason, in the area adjoining the tip of the profile, the upper leg is embodied to be slightly bent towards downwards and inwards, that is, in the direction towards the center of the shelf, to let any contaminations that fall thereon fall downwards onto the next dividing elements. Correspondingly this one leg, which in the mounted state is the upper leg, is embodied to have a [cranked] profile, wherein the end area, which in the mounted state extends horizontally, has an extension that is at least as great as the width of an upright profile, preferably considerably wider, for example twice as wide, as viewed in the front view, so that a stop can be arranged in the additional width area at the front end of the V-profile, forming the front stop e.g. for the temperature-control panel that is placed thereon and projecting upwards over the upper side in the mounted state, the outer side of this leg.

In this manner, the lateral non-heated edge area of the temperature-control panel extends substantially above the bearing strips, and extends only a little or not at all into the free inner space between the inner corner edges of the upright profiles of the base frame, so that the surface of the top side of the temperature-control panel can be used almost without restrictions in the edge area for the placement of products thereon.

If the temperature-control panel is positioned not horizontally in the dispensing shelf, but rather so as to be slightly tilted upwards towards the back in the depth direction, for one thing, a front stop is necessary for positioning the temperature-control panel in the depth direction. It can be attached on a frontal obliquely extending stop bar, for example a cross bar on which also a price tag unit can be attached, or directly at the base frame, preferably its upright profile, or at the bearing strips. The front stop can in particular be adjustable with respect to its distance from the front end of the base frame of the front upright profile, for example to the front end of the same.

Preferably, also a rear stop for the temperature-control panel is present to avoid a backwards displacement of the temperature-control panel, in particular by the removing person. Such a rear stop is preferably attached at one of the bearing strips, in particular at both bearing strips.

Since manufacture of the temperature-control panels is elaborate, an effort is made to make do either with only one structural design or maximally two structural designs of the temperature-control panel in particular with respect to their dimensions—despite the varying length of the bearing strips in the depth direction from level to level, as for example caused by an obliquely positioned front side and different inclination angles of the bearing strips:

In this way, it is possible to design at least all temperature-control panels in the dispensing shelf that are located below the uppermost temperature-control panel to be the same with respect to the dimensions, which on some of the lower levels results in a passage behind the rear edge of the temperature-control panel up to the rear end of the base frame due to the different length of the bearing strips if the front edge and also the front stops for the temperature-control panel are arranged as far in the front as possible. If the storage spaces arranged above each other, that is, the air spaces of the individual levels, are supposed to take on the same temperature, these rear passages can remain air-permeable, if not, an air-impermeable closure must be realized here, for example by means of a closing plate.

The uppermost temperature-control panel is shorter in its length as measured in the depth direction. The lowermost temperature-control panel preferably has an insulation preferably on the entire bottom side, or it is not placed directly on its supports, in particular its bearing strips, but rather by placing a bearing shell or another, non-heated, compartment base in between, which restricts the heat radiation downwards, in this case with its lateral edge being located respectively in an insulating manner between the edge of the temperature-control panel and the bearing strip.

To ensure that the base frame, which in most cases consists of metal, is temperature-controlled along with that as little as possible by the temperature-control panel, all contact surfaces between the temperature-control panel and the base frame are, for one thing, kept as small as possible and, for another thing, thermally decoupled as much as possible by means of intermediate layers made of a thermally insulating material.

Due to the fact that the recesses in the front corner area of the temperature-control panel in the width direction are larger than the width of the cross section of the upright profile accommodated therein, to take out the temperature-control panel it can be pushed towards a side up to a stop of the upright profile in the recess that is present there, wherein in this case prior to that the side edge of the temperature-control panel has to be lifted and pushed over the adjacent temperature-control panel or the other dividing element present there in an analogous adjacent dispensing shelf.

However, then the other side of the temperature-control panel can be lifted up to a pivot angle of 20°, 30° or even of 40°, even if a side wall had been present in the base frame above this edge area of the temperature-control panel in the central state, as will be explained later.

This oblique position is required for the assembling technician to pull out the temperature-control panel backwards in between the rear upright profiles.

The power supply unit, which in most cases is a part of the electrical control unit for the electrically operated temperature-control panels, is located below the lowermost shelf, at least below the lowermost temperature-control panel in the base frame, in most cases in the base space and close to one of the sides of the base frame, oriented with the operating unit towards the operator standing behind the back side. This control unit and/or power supply unit can also supply other electrically operated components of the dispensing shelf, for example light sources, with current and control them.

The power cables and/or data cables, in most cases a combined data/power cable, with a plug being located at its free end in most cases, preferably leads out of the rear narrow side of the temperature-control panel not in its center, but close to one of its side edges. On this side, preferably at the upright profile, a cable channel is mounted by collecting the cables that are guided by the individual temperature-control panels, and leading them downwards, wherein an inlet opening for a cable is present in the cable channel preferably at the height of each rear edge of a temperature-control panel, wherein the cable channel can of course also be open across its entire length.

As a general rule, corresponding plug sockets are located inside the control unit that is located in the base space, or a corresponding plug socket bar is already arranged at the upright profile further above. The cable channel preferably consists of a thermally insulating and electrically non-conductive material, usually of a plastic material.

Instead of a separate cable channel, the upright profiles can also be configured as hollow profiles, and the corresponding hollow profile to which the control unit and also the cable outlets from the temperature-control panels are adjacent are used as a cable channel with corresponding outlet openings, in particular an open side of the cross section.

In this manner, the operator, which as a general rule operates on the back side of the shelf, can set the operating unit, preferably each individual temperature-control panel, with the desired temperature or temperature range, and preferably is also shown the temperatures of the individual temperature-control panels, preferably from each of the individual temperature sensors present there and thus in the individual temperature-control areas, on a display unit.

The control should be capable of maintaining the set target temperature at the temperature-control panel up to a deviation of +/−15° C., better of +/−10° C., better of +/−5° C. at the temperature-control panel, on the one hand, and—if also in the air space, for example attached at the base frame, a temperature sensor that is connected to the control is present—also the temperature in the air space.

Also, light bars extending in the depth direction can be arranged at the bottom side of the bearing strips, radiating obliquely downwards and inwards and illuminating the products on the next shelf below, in particular the next temperature-control panel below.

Since these light bars also emit heat—depending on the used illumination means (LEDs or conventional illumination means) to a greater or lesser extent—exactly in the lateral edge area in which the curtain of rising warm air is supposed to be generated, these light bars contribute to increasing the temperature especially in the air space of this edge area. By means of corresponding sensors, this temperature can be measured, and the temperature in the strongly heated lateral edge area of the temperature-control panel can be controlled correspondingly, in particular it can be controlled to be lower than if light sources eradiating from above are present.

Such an air curtain is necessary in particular in the case that the air space at the side surfaces of the base frame is open and not delimited.

However, preferably the sides of the base frame are at least partially closed by one continuous or by multiple individual side plates, preferably across at least 70%, better at least 80%, better at least 90% of the side surface of a rack or at least the side surface of each individual level, that is, each individual storage space.

Such individual side plates—in particular side panels made of a translucent material such as translucent plastic material or translucent glass—can be arranged in a fixed and unmovable manner at the base frame on each level, or can also be arranged so as to be pivotable slightly outwards about a pivot axis extending in the depth direction, so that the lower edge of the side plate can be slightly pivoted outwards, so that the side edge of the temperature-control panel can be lifted upwards past it to take out products in the obliquely positioned state.

This pivot axis can be the same pivot axis at which also the reach back protection device can be mounted in such a side surface in the base frame of the dispensing shelf and also the side plate can in particular additionally have the function of a reach back protection device if the pivot range is correspondingly defined, as is explained based on the drawings.

Preferably, also such a single side plate closes the side surface of this storage space by at least 70%, better by at least 80%, better by at least 90% per level.

Also, the back side of the dispensing shelf is usually closed by a single-wing or double-wing rear door, which preferably extends over the entire height of the storage area in which the storage spaces are located, or again divided over the height of respectively one level, that is, over the height of each storage space. Such a rear door preferably consists of mirror-coated glass which is, however, translucent in one direction, so that such a rear door is translucent from the back side for the operator, so that the loading state of the individual shelfs can be checked, but is not translucent, but mirror-coated for the customer standing in front of the dispensing shelf.

Here, on the grip side, the usually rectangular rear doors have an indentation extending along its rim that is located there and serving for letting the rear door of a directly neighboring base frame, which has its hinge on this side, enter the recess [with its hinge] when the neighboring rear door is opened, so that a distance between the base frames can be forgone and the use of the space is improved.

In contrast to that, the back side of the shelf below the lowermost compartment base, in particular below the lowermost temperature-control panel, is usually open, and this base space can be accessed from the back.

If the front side of the storage space is also entirely or partially open, a warm air curtain is required there as well, which can also be created here by a strongly heated front edge area of the heating plate and/or lighting devices that irradiate this front edge area from above, thus emitting heat.

The top side of the shelf—which is preferably tilted obliquely backwards—is closed with a cover plate, which preferably consists of a thermally insulating material and/or of a mirror that is mirror-coated towards the bottom side.

c) Exemplary Embodiments

Figure 1C:
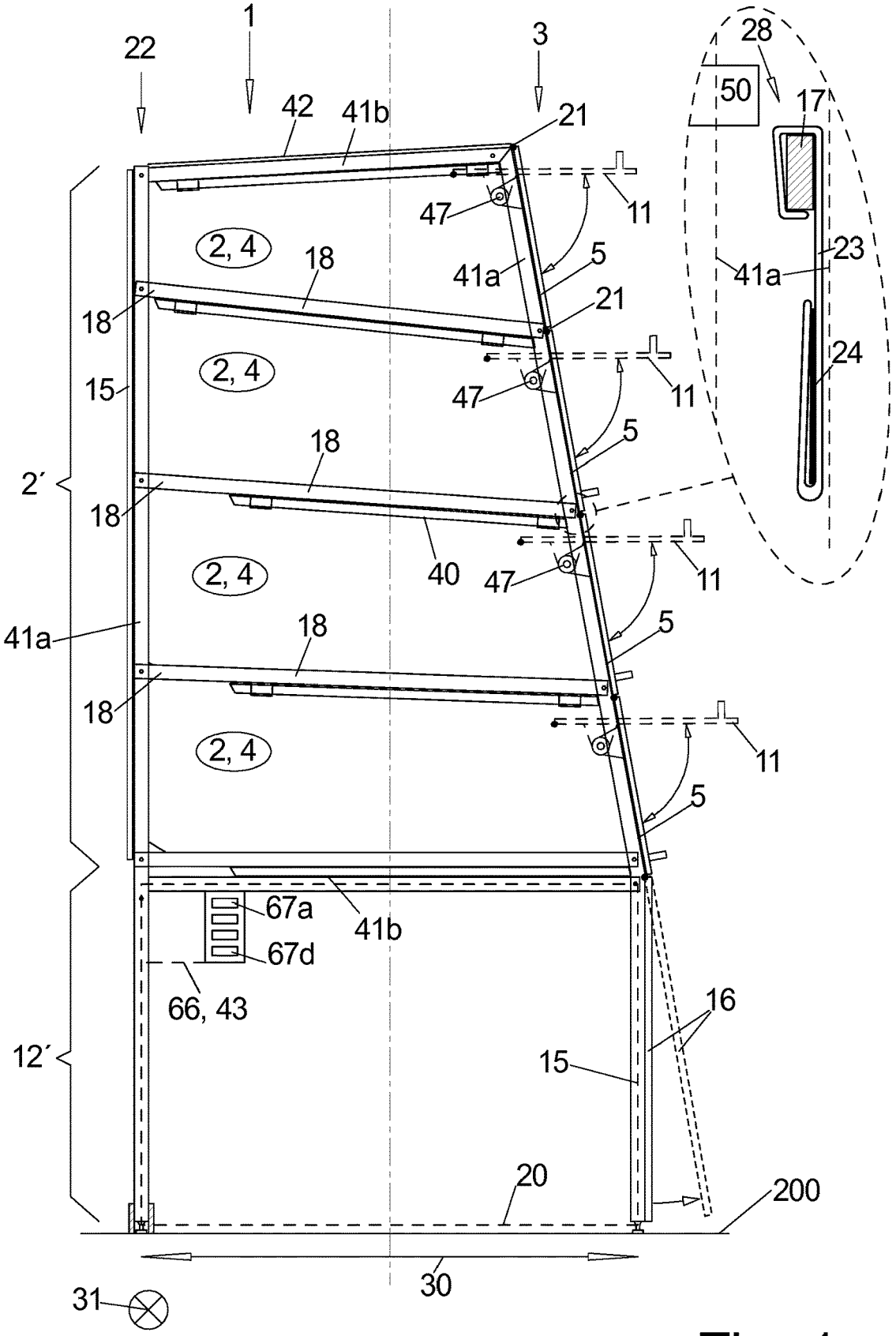
Figure 2A:
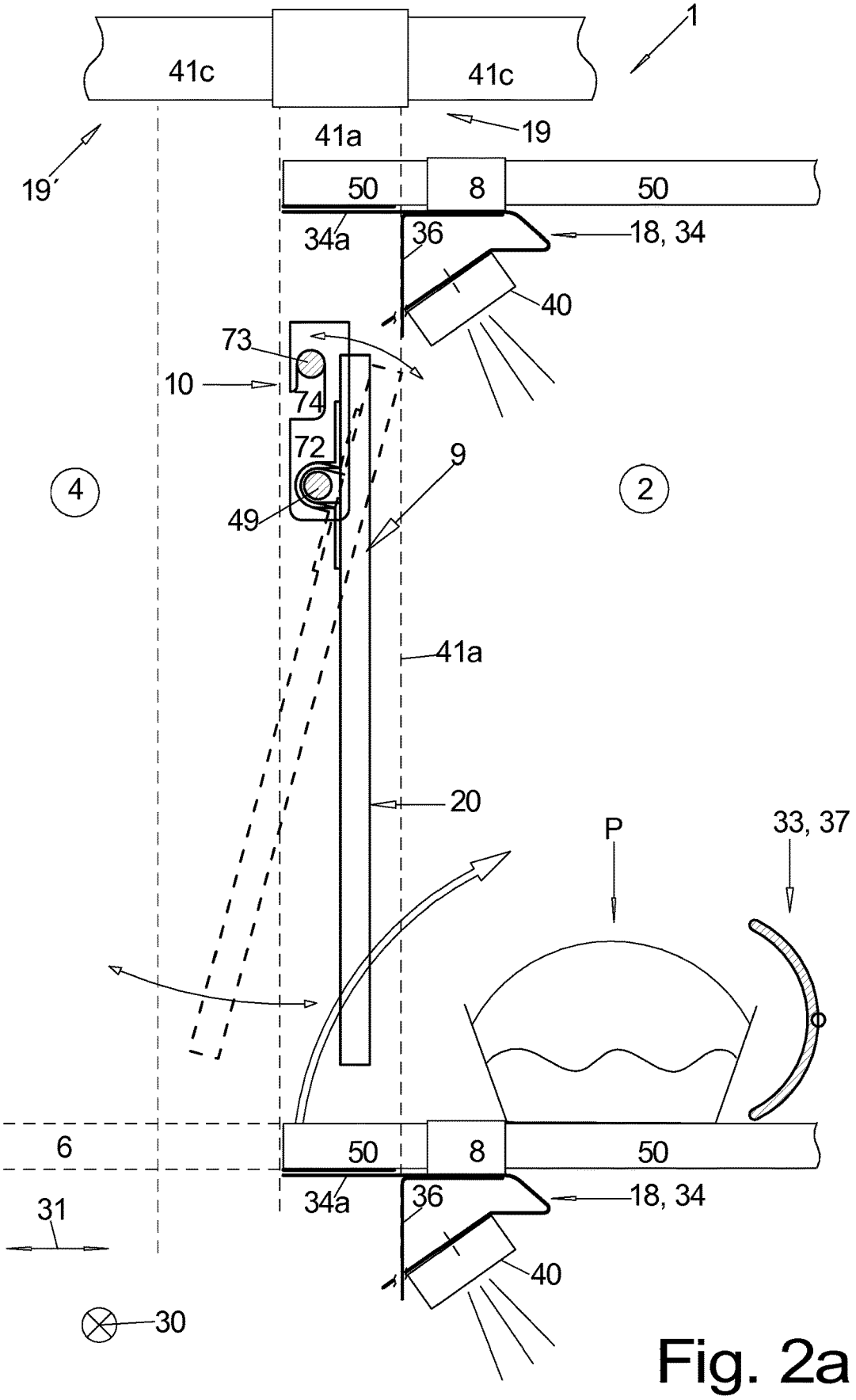
Figure 2B:
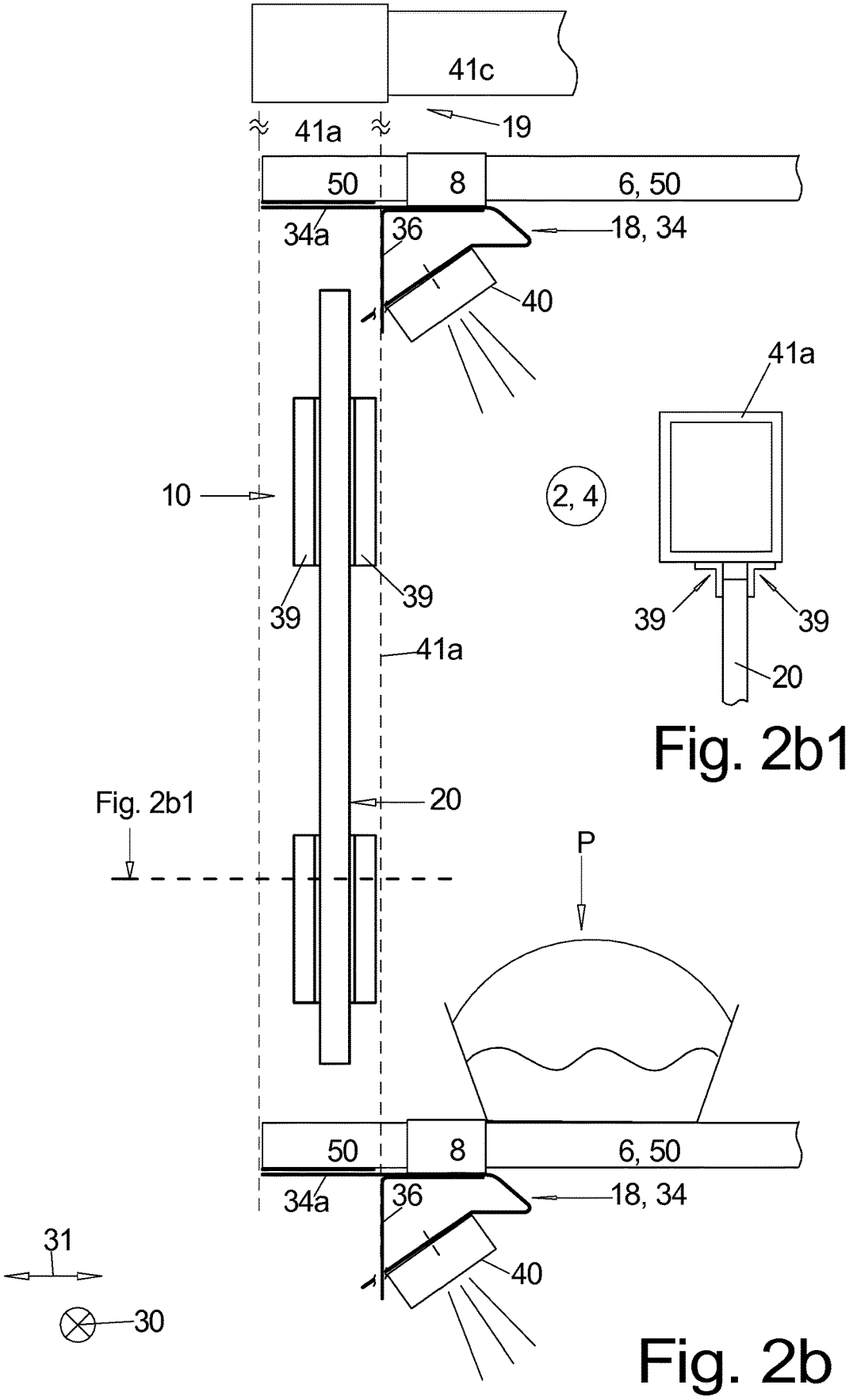

In the following, embodiments according to the invention are described in more detail by way of example. Herein:

FIG. 1*a*: shows the dispensing shelf in the side view, that is, as viewed in the width direction, with a first front design, FIG. 1*b*: shows the dispensing shelf in the front view, that is, as viewed in the depth direction from the front, FIG. 1*b*1: shows an enlarged view of FIG. 1*b*, FIG. 1*c*: shows the dispensing shelf in the side view with a second front design, FIG. 2*a*: shows a reach back protection device with a side plate, FIG. 2*b*: shows a reach back protection device with a fixedly mounted side plate, FIG. 2*b*1: shows a partial section view of a portion of the device shown in FIG. 2*b*, FIGS. 3*a-c*: show a temperature-control panel in different views, FIG. 3*a*1: shows an enlarged view of FIG. 3*a*, FIGS. 4*a-c*: show sections through different edge designs of a temperature-control panel.

FIG. 1*a* shows a side view and FIG. 1*b* shows a front view of a single dispensing shelf 1, from which it can initially be seen that the dispensing shelf 1 has a frame-like base frame 19 which consists of profiles 41 that are welded or screwed together, namely of vertically extending upright profiles 41*a*, depth profiles 41*b* that extend in the depth direction 30, as well as transverse profiles 41*c* that extend in the width direction 31, the transversal direction.

In this manner, a base frame 19 is created, which is rectangular in the front view, that is, having left and right upright struts 41*a* that extend in parallel to each other as well as horizontally extending depth profiles 41*b*, as well as cross struts 41*c*.

The transverse profiles 41*c*, which extend between the rear as well as the front upright profiles 41*a*, are present in the height only at the upper end as well as in the lower half, at approximately a third of the total height of the dispensing shelf 1, which is approximately as tall as a person, so that the lower transverse profile 41*c* is located approximately at the knee height of an adult user 100 who stands in front of it, or slightly higher.

It can also be seen in the side view of FIG. 1*a* that the depth profiles 41*b* are also only present at two positions, namely between the upper ends of the front and rear upright profiles 41*a* as well as approximately at the same height as the lower transverse profile 41*c* in FIG. 1*b*.

In the side view, a depth profile 41*b* could additionally also be present at the lower ends of the sides of the front and rear upright profiles 41*a*. However, there is no additional transverse profile 41*c* present at the height of the lower ends of the upright profiles 41*a*, as can be seen in FIG. 1*b*, so as not to compromise accessibility from the front between the upright struts 41*a* in the base area 12' slightly above the ground.

The side view of FIG. 1*a* shows that, in the side view, the base frame 19 is not rectangular in total but only in the lower area, that is, up to the lower of the two depth profiles 41*b*, and has a vertical front side 3 there, while from there on upwards and thus in the largest part of the front side 3, it is formed to be tilted, that is, in this area the frontal upright profile 41*a* comes closer to the rear, continuously vertical upright profile 41*a* in the upwards direction.

Further, the depth profiles 41*b* that connect the upper ends of the upright profiles 41*a* do not extend horizontally, but so as to be slightly tilted from the front side 3 towards the back side 22 of the base frame 19. This top side of the dispensing shelf 1 is closed by a cover plate 42 that is placed onto the base frame 19 from above.

The front side 3 of the base frame 19 in front of which the user 100 stands, intending to take out products P from the dispensing shelf 1, can be completely open or more or less closed, as will be explained in the following, and the side surfaces can likewise be open or closed.

The back side 22, from which the dispensing shelf 1 is usually filled with products by the operator, is either open or closed by rear doors 15 or flaps that are to be opened, as will also be explained.

Above the lower depth profile 41*b* and the transverse profile 41*c*, on different heights between the left as well as between the right front and rear upright profiles 41*a* and respectively left and right at the same height, bearing strips 18 are attached, usually screwed on, at the upright profiles 41*a* on which—as shown in FIG. 1*b*1 as viewed from the front—plate-shaped dividing elements 6, such as for example temperature-control panels 50 or shelves, for products P to be placed thereon and sold are placed with their edge area.

Here, the bearing strips 18 and thus the dividing elements 6 are arranged so as to be tilted downwards from the back side 22 towards the front side 3, and namely with an increasing inclination from the uppermost to the lowermost bearing strip 18, wherein the lowermost bearing strip 18 can also be arranged horizontally, as shown in FIG. 1*a*.

Thus, the dividing elements 6, here temperature-control panels 50 or also simple bearing shells 6 for products P, divide the inner space of the dispensing shelf 1 in the height into individual levels or compartments, whereby individual storage spaces 2 for the products P are created, namely between the individual dividing elements 6 as well as between the uppermost dividing element 6 and the upper end of the base frame 19 of the dispensing shelf 1, that is, usually the cover plate 42.

The area below the lowermost dividing element 6 is referred to as a base space 12, so that the dispensing shelf 1 is divided into a storage area 2' and a base area 12' also in the height.

The front side 3 is usually closed in the base area 12' by a front plate 16, which, however, can be opened due to the front plate 16 being openable and in the present case being embodied as a flap and attached in a pivotable manner at the base frame, in particular the lower transverse profile 41*c*, by means of one or multiple hinges 21 at its upper edge.

In the opened state, this facilitates access into the base space 12 from the front, either to clean the base surface 200 therein or to stock goods there. The closing process of the front plate 16 is slowed by a closing damper 25, thus dampening the impact.

As shown in FIG. 1*b* at the left side of the dispensing shelf 1, the sides of the dispensing shelf 1 can be closed if needed by means of a lateral side plate 20 on one or both sides, respectively as required either only in the base area 12' or also in the storage area 2', which, among other things, depends on whether multiple such dispensing shelves 1 are positioned next to each other as viewed in the front view of FIG. 1*b* and/or whether or not in that case the adjacent storage spaces 2 have to be separated from each other.

Among other things, this depends on whether bearing shells 6 or dividing elements with another function, for example temperature-control panels 50—heating plates for keeping products P warm or cooling plates for cooling products P—are used as the dividing elements, since in that case a respective storage space 2 may have to be mostly closed towards all sides already for reasons of thermal insulation.

Thus, the front view of FIG. 1*b* shows a side plate 20 that extends continuously over the entire height of the base frame 19 which in that case, however, has to rest externally on the side surface of the base frame 19 as a general rule, which is not optimal when multiple base frames 19 have to be placed next to each other.

In contrast, what can be seen in FIG. 1*a* in the upper two storage spaces 2 or take-out rooms 4 are respectively individual side plates 20, in this case formed as at least partially translucent side panels 20, that are inserted into the free space between the front and rear upright profiles 41*a* that delimit this storage space 2 in the side view as well as the bearing strip 18 extending above and below it, in the uppermost storage space 2 between the depth profile 41*b* located above it and the bearing strip 18 located below it, which will be explained in more detail based on FIGS. 2*a, b*.

In FIG. 1*a*, the two upper levels are shown simultaneously as storage space 2 and removal space 4 at the same time, with the storage front plate 11 that respectively closes this space 2, 4 on the front side 3, extending across the entire front surface of this space 2, 4 and being formed as a door with a lateral hinge that can be opened by the removing person 100 to then be able to directly take out a product P, in the present case a food product that is filled into a kind of small basket.

To ensure that the storage front plate 11 does not unintentionally remain open and the heat which is generated by the heating plate 50 that is respectively provided there as a shelf and thus a dividing element 6 escapes from the storage and removal space 2, 4, these storage front plates 11—no matter whether in the design as a door like in FIG. 1*a*, or as a flap like in FIG. 1*c*—are formed in such a manner that they automatically close, in particular due to gravity, upon being released.

To ensure that the impact on the front upright profile 41*a* does not become too hard, a stop damper 27, which may for example consist of plastic material and onto which the storage front plate impacts (FIG. 1*a*), is attached on the front side of the upright profile 41*a*, in particular adhesively attached, preferably in the solution as a door.

For it to be reliably kept in the closed state, a magnet 26 is attached at the storage front plate 11 on the side that is facing the base frame 19 in the area of the upright profile 41*a* which is sufficiently strong to hold the storage front plate 11 in this position on the base frame 19 made of iron when it comes to rest at the stop damper 27.

As shown in FIG. 1*a*, the magnet 26 is arranged in such a manner that it comes to rest against the stop damper 27 which, however, does not necessarily have to be the case: The magnet 26 could also be arranged so as to be offset with respect to the stop damper 27, so that in the closed state the storage front plate 11 rests directly at the stop damper 27 if the magnet 26 is thinner than the stop damper 27.

In FIG. 1*a*, in the lowermost level of the storage area 2', the space that is delimited downwards by the lower depth profile 41*b* and the stop bar 18 arranged above it is shown to be only used as a storage space 2, so that accordingly the removing person 100 is not supposed to and not able to directly reach from the front side 3 into this storage space 2, but rather only by means of a tool 37 extending into this storage space 2 from the outside, such as a slider 33 which extends through a narrow tool opening 14 in the storage front plate 11. The removing person 100 can hold this tool at the outer end outside of the dispensing shelf 1 and, with the end that is located in the dispensing shelf 1, that is, inside the storage space 2, displace a products P located therein, and namely into a removal space 4 that in the view direction of FIG. 1*a* is located in front or behind it, e.g. of a further base frame 19 attached at the side, as shown based on FIGS. 2*a, b*.

In this case, the removing person 100 should of course as far as possible not be able to open the storage front plate 11, but it should still be possible to be open it for cleaning purposes etc. at least by the personnel.

For this reason, the storage front plate 11, which in this case is also embodied as a door, is secured with a control mechanism 48 at its free end at one of the upright profiles 41*a*, as shown in the enlarged view:

Here, for example at the base frame 19, a displaceable in particular pivotable, e.g. L-shaped latch 45 is attached, with its cranked extension 45*a* meshing in the locked state into a recess 46 that is attached at the inner side of the storage front plate 11.

Thus, this latch mechanism 48 cannot be opened at all through the tool opening 14 or can only be opened with much effort, and is usually opened by the personnel from the back side 22 of the dispensing shelf 1 that is either designed to be open at the rear, or is opened.

Especially when temperature-control panels 50 are used as dividing elements 6 in the dispensing shelf 1, but also independently of whether this is the case, the back side 22 of the dispensing shelf 1 is also supposed to be closable.

For this reason, in FIG. 1*a* the back side 22 is closed by a separate rear door 15 which extends on the back side of the base frame 19 across a height of each compartment, that is, each level, and which is usually also embodied as a panel that is translucent at least from the outside towards the inside to make it possible for the personnel to see the loading state in the interior of the storage space 2 or removal space 4.

As can also be seen in FIG. 1*a*, the temperature-control panels 50, 50' that are used on each level as a shelf 6 have different lengths in their extension in the depth—or more precisely in the extension direction of the bearing strips 18 on which they respectively rest—, which, among other things, is due to the increasing inclination of the bearing strips 18 from the lowermost, non-tilted, to the uppermost bearing strip 18, as well as due to the tilted front side:

However, because—despite the increasing inclination of the bearing strips 18 due to the stronger effect of the inclination of the front side 3—the length of the bearing strips 18 decreases from the bottom up, the length of the shortest, uppermost temperature-control panels 50 is chosen such that they extend substantially across the entire length of their bearing strips 18.

Thus, the second temperature-control panel 50 from above and all temperature-control panels 50 located below it are slightly longer than the uppermost temperature-control panel 50, but are all of the same length, that means that they have the same length in their depth direction, that is, in the mounted state in the extension direction of the bearing strips 18, and namely are chosen in such a manner that the second temperature-control panel 50 from above substantially extends across the entire length of its bearing strips 18.

Since a front stop 8 for the front edge of the temperature-control panels 50 is formed at the bearing strips 18 respectively at the front end—in the side view of FIG. 1*a* in a non-visible position arranged in the depth area of the front upright profile 41*a*—, [and] the third bearing strip 18 from above and the bearing strips 18 that are positioned further downwards are even longer, what results behind the rear end of the temperature-control panels 50 in the third and fourth bearing strip 18 from above is a respectively increasing gap to the back side of the dispensing shelf 1.

This is tolerated in order to reduce the number of different lengths and thus structural designs of the temperature-control panels 50, and is safe as long as both storage spaces 2, that is, below and above the temperature-control panel 50 that are dividing them as well as the gaps behind it, are temperature-controlled to approximately the same temperature. If this is not the case, this gap has to be closed by means of a fitting covering strip which preferably extends continuously from the left to the right bearing strip 18.

The temperature-control panel 50' resting at the lowermost level and thus the lowermost bearing strip 18, which in most cases extends horizontally, is additionally insulated on its bottom side to avoid radiation of heat—in a heating plate 50—downwards into the base space 12.

FIGS. 3*a, b* show the design of the temperature-control panels 50, 50' in detail, and namely FIG. 3*a* in the top view from above, that is, onto the main plane 51' of the temperature-control panel, FIG. 3*b* in the front view in a partially sectioned manner, and FIG. 3*c* in the side view.

This clearly shows that the temperature-control panel 50, 50' respectively consists of a composite plate 51, that is, quasi the main plate at which diverse attachment parts are attached.

Figure 4A:
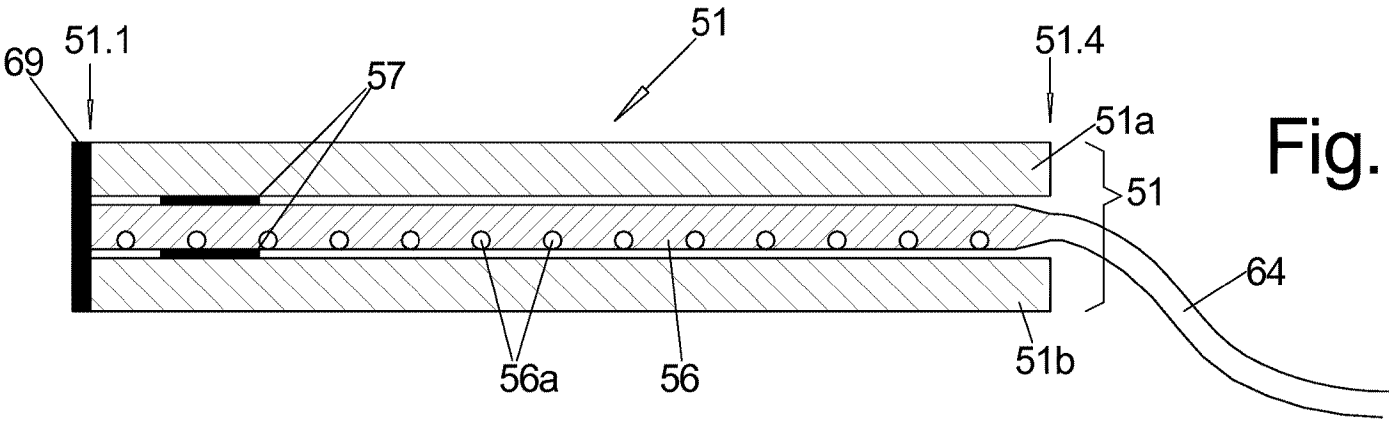
Figure 4B:
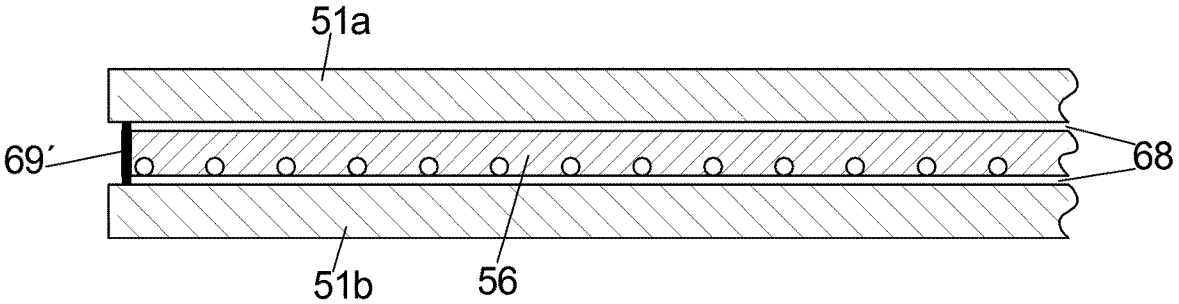
Figure 4C:
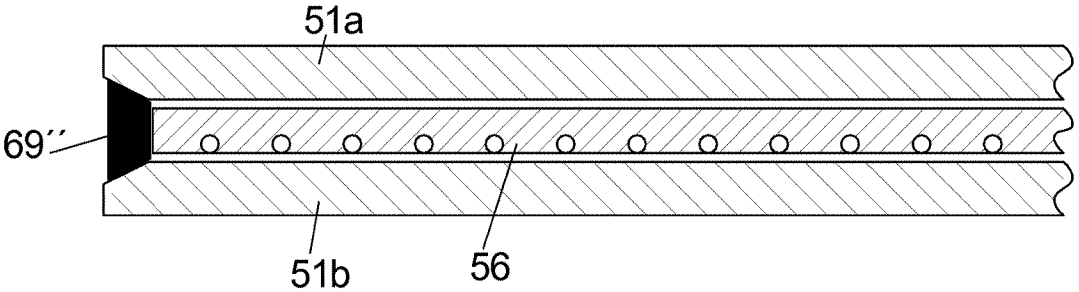

It is referred to as a composite plate 51 because—as shown in FIGS. 4*a-c* in the cross section—this composite plate 51 consists of a flat top plate 51*a* and a flat bottom plate 51*b*, which are preferably both glass plates, and which, together with a temperature-control layer 56 that is fixedly attached between then, from the composite plate 51 which has a main plane 51' that is positioned in parallel to the top side and/or the bottom side of the composite plate 51 which usually extend in parallel to each other. Thus, as a general rule, the main plane 51' of the composite plate 51 is also the main plane of the temperature-control panel 50, since the attachment parts present in addition to the composite plate 51 have a much lower extension as compared to the composite plate 51.

The temperature-control layer 56 can be made of any desired material, but contains electrically conductive elements 56*a*, for example heating wires 56*a* that can be heated by means of electrical current, and heat up the top plate 51*a* and the bottom plate 51*b* to the desired temperature.

To measure this temperature, temperature sensors 57 are further arranged between the top plate 51*a* and the bottom plate 51*b*, with their signals reaching the control unit 66 and the associated power supply unit 43 to which the temperature-control panels 50 are connected, preferably via the cable that conducts the electrical current to the conductive elements 56*a*.

The temperature sensors 57 are preferably arranged in the adhesive layer 68 to which the temperature-control layer 56 is adhesively bonded respectively opposite one of the glass plates, preferably on its bottom side and on its top side.

Further, the left end of the sectional renderings of FIGS. 4*a-c* show solutions for covering the temperature-control layer 56 that is visible and accessible from the front face:

In a first solution according to FIG. 4*a*, a cover strip 69, which is preferably made of stainless steel, extends across the entire thickness D, that is, height, of the composite plate 51, but does not project beyond the same in height, and also does not surround the upper or lower edge of the composite plate 51, since inner corners and inner edges at which dirt can collect would be formed in this way.

However, this solution has the disadvantage that such a cover strip 69, especially if it is made of a material with a higher thermal conductivity than glass, can cause burns easier when touched than when e.g. the top side of the top plate 51*a* made of glass is touched. Especially with the frontal narrow side of the composite plate 51, the temperature-control panel 50, this frontal narrow side should preferably be protected, e.g. by a cross bar 17 that is arranged in front of it in the base frame 19 and extends at a small distance in front of the cover strip 69:

In FIG. 1*c*, such a cross bar 17, which can be attached between a left and a right front upright profile 41*a*, preferably by simply suspending it, is shown in an enlarged sectional rendering as being positioned too low for this function, serving preferably as a price tag holder as a price tag unit 28 can be attached thereat, as can be seen in this sectional rendering:

It consists of a price tag holder 23 in the form of a plastic material profile that is cranked multiple times in the cross section and extends in the same direction, the width direction 31, as the cross bar 17:

In the upper area of the price tag holder 23, it is cranked three times by respectively approximately 90°, so that what results is an almost closed, approximately rectangular inner contour into which the cross section of the cross bar 17 fits. Since the material of the price tag holder 23 is sufficiently elastic, this multiply cranked structure can be bent open so far that the price tag holder 23 can be pinned onto the cross bar 17 from above.

In the lower area, the price tag holder 23 is cranked once by approximately 180° and thus forms a U-shaped pocket that is open upwards, and into which the price tag 24 for the products offered in the corresponding level, usually the level below the cross bar 17, can be inserted from above.

Thus, the entire price tag unit 23 is located in the area of the dimensions of the base frame 19, since the cross bar 17 is positioned not in front, but in the depth area of the front upright profiles 41*a*, and is thus protected behind the front storage front doors 11.

To protect the frontal narrow side of the temperature-control panel 50, the cross bar 17 could be arranged higher so as to cover the same.

FIG. 1*c* further shows another design of the front side 3 of a dispensing shelf 1, namely where the storage front plates 11 are respectively embodied as a plate that is to be opened by being pivotable horizontally, extending respectively over a height of the front surface of one of the storage spaces 2 and/or take-out rooms 4.

In this solution, a damper for slowing down the gravity-caused closing motion is present preferably in the joint of each of these storage front plates 11 embodied as flaps, that is, about the plate pivot axis 47.

In a second variant, FIG. 4*b* shows a cover strip 69' that is offset backwards with respect to the frontmost front face of top plate 51*a* and bottom plate 51*b*, and in this way can be touched less easily:

Here, the cover strip 69', which is also bar-shaped, that is, rectangular in the cross section, either extends only in the thickness area of the temperature-control layer 56 and the adhesive layers 68, or the glass plates are chamfered at their rim that is respectively facing the other glass plate—as shown in FIG. 4*c*—, so that the backwards offset cover strip 69" can have a rhombic or triangular cross-sectional shape, and can be better adhesively bonded to the glass plates 51*a*, 51*b* due to their larger contact surface with them.

In the renderings of FIGS. 3*a, b, c* such optional cover strips 69, which are in particular arranged along the front side and/or also the side surfaces, are indicated only in partial areas.

Instead of stainless steel, such cover strips 69 can also consist of a different material, with its thermal conductivity preferably being not greater than that of glass, in particular of plastic material. In particular in the structural design according to FIG. 4*c*, such a cover strip 69 made of a paste-like material, such as for example silicone, can be applied and subsequently cured.

FIGS. 3*a, b, c* primarily show the other attachment parts at the composite plate 51, which in most cases consist of stainless steel sheets:

For one thing, the protective coating 59 in the form of a stainless steel strip that is visible in the front view of FIG. 3*b* in the left area and that extends in the edge area along one of the side edges 51.2, 51.3 of the composite plate 51, namely in the support area 58 or also in a slightly wider or more narrow design, in the depth direction 30 preferably across the entire extension of the composite plate 51 on its bottom side.

The width of the protective coating 59, that is, the support area 58, can be of the same size or larger, wider or narrower than the surface with which the temperature-control panel 50 laterally rests on the bearing strips 18 in the mounted state.

At the back side, that is, along the rear edge 51.4, of the composite plate 51, a rear profile 70 is arranged, extending in the transversal direction 31 and in most cases being made as bent sheet metal parts from stainless steel, and having multiple functions:

For one thing, the rear profile 70 projects as a rear bar 61—substantially across the entire width of the rear edge 51.4 of the composite plate 51—upwards beyond its top side, and is supposed to prevent that products P placed on the composite plate 51 are accidentally pushed back so far backwards by the removing person 100 that they are dropped down over the rear edge 51.4 of the composite plate 51.

For another thing, a cable 64 that provides current to the temperature-control layer 56 extends out from the rear area, in particular the rearward narrow side, of the composite plate 51, as shown in FIG. 4*a*, and in most cases does so not in a corner area of the composite plate 51, but in the central area.

To guide this cable 64 to the side, that is, to one of the rear upright profiles 41*a* at which a cable channel 29 is attached in a vertically extending manner for guiding these cables 64, this rear profile 70 is at the same time used as a cable guide at the bottom side of the composite plate 51 via which it extends downwards and outwards, as can be seen in FIG. 3*c:*

As viewed in the side view, that is, in the extension direction of this rear profile 70, for this purpose, the rear profile 70 has the cross sectional shape of a U-shaped cable duct 71 that is open towards the back in the area below the composite plate 51, so that the cable 64 can be placed inside it and can be guided towards the side.

This rear profile 70 is attached, preferably adhesively bonded, with the upper leg of the U-shaped cable duct 71 only at the bottom side of the composite plate 51, and has the cross-sectional shape that is shown in FIG. 3*c*, consisting of the U-shaped cable duct 71 and the rear bar 61 that projects upwards from the free end of its upper legs.

A further attachment part can be a protective cover 59, which does not extend only over the support area 58 as a strip extending in the depth direction along the bottom side of the composite plate 51, as shown in FIG. 3*b* in the left area, but substantially across the entire bottom side of the composite plate 51, and of course also in the support area 58, where it is supposed to provide a thermal insulation against the bearing strips 18 on top of which the temperature-control panel 50 rests.

This is necessary in the lowermost of multiple temperature-control panels 50 in a dispensing shelf 1 to prevent any heat radiation of a heating plate downwards into the non-heated storage space 2 which is located below it, in most cases in the lowermost level, to avoid a radiation of heat into the base space 12 located below.

Such a continuous protective coating 59 is then preferably embodied as a tray with a dipped portion in the central area, where in this way an insulating layer 60 of thermally insulating material is present in the created distance between bottom side of the composite plate 51 and the sunk-in central area of the tub-shaped protective cover 59.

The edges that are curved upwards and extend in parallel to the main plane of the tub-shaped protective cover 59 are preferably present in the side areas—for the function as an intermediate layer between the composite plate 51 and the supporting bearing strips 18 in the support area 58—and in the front area—as a visual protection towards the front to avoid that the insulating layer 60 can be seen—and preferably also in the area of the back side, that is, present circumferentially.

Due to the overhang downwards over the bottom side of the composite plate 51, the cable duct 71 at the same time forms a gripping bar 62 at which the personnel can grip the temperature-control panel 50 and pull it backwards out of the base frame 19.

Further, it can be seen in the top view of FIG. 3*a* that the two front corners of the composite plate 51 of the temperature-control panel 50 have respectively one corner recess 63, extending in a rectangular manner with the legs in parallel to the outer edges of the composite plate 51 and having a rounded inner corner, with the latter serving to prevent the generation of interior tensions in the glass plates.

The extension of the recess 63 in the width direction 31 is larger than the width of the upright profiles 41*a*, as viewed in the top view from above, and the extension in the depth direction 30 is larger than the extension of the front upright profile 41*a* which extends in the depth direction 30 partially and in the width direction 31 completely inside the corner recess 63.

In the state in which it is inserted into the dispensing shelf 1, the temperature-control panel 50 is preferably positioned in the base frame in such a manner that the usually obliquely forwards tilted temperature-control panel 50 abuts at each side at a front stop 8 with the front edge 51.1 of its composite plate 51—which in FIG. 3*a* is only shown on one side—, with the front stop 8 being preferably attached at the bearing strip 18 (see FIG. 2*a, b*), so that, with its cross section, the frontal upright profile 41*a* is located partially in the corner recess 63 without touching the composite plate 51. However, the front edge of the composite plate 51 is offset backwards with respect to the front edge of the cross section of the front upright profile 41*a*, so that the cross bar 17 with the price tag unit 28 can still be accommodated in the forwards overhang of the front upright profile 41*a*, as shown in the enlarged rendering of a section in FIG. 1*c*.

The width of the composite plate 51 as measured in the width direction 31 and thus the width of the temperature-control panel 50 is chosen in such a manner that, in the mounted state, it extends up to or close to the outer edges of the bearing strips 18 on which it rests, but not to beyond the base frame 19.

The top view of FIG. 3*a* onto the composite plate 51 further shows the possibly present temperature-control areas 52*a, b* that are to be temperature-controlling independently of each other:

For one thing, due to manufacturing reasons, each composite plate 51 has a non-heated, because un-heatable, edge area 53 that is present at least on two facing sides, in this case extending along the depth direction 30. The width of this non-heated edge area 53 is larger than the width of the support area 58 in which for example the composite plate 51 is supposed to rest on the bearing strip 18 located below.

However, the area located inside, that is, between the two non-heated edge areas 53, is preferably not only one single temperature-control area:

Rather, preferably there is a ring-shaped circumferential heated edge area 54 located between the non-heated edge areas 53, that is, inside the non-heated edge areas 53, and also if they are present at all four rims of the preferably rectangular composite plate 51, and this heated edge area 54 encloses a core area 55. In this manner, the heated edge area 54 can be heated up to a higher temperature than the core area 55, independently of whether it extends only in the depth direction or only along the width direction or is formed as a circumferential area, and in this way a kind of warm air curtain from the strongly heated edge area 54 can be created, which reduces the cooling at the cooler lateral boundaries such as side plates 20, rear door 15, or front plate 11.

FIG. 2*a, b* as well as FIG. 1*c* show how the bearing strips 18 can be designed.

For one thing, the bearing strip 18 comprises a V-profile 34 that is arranged horizontally in the mounted state and substantially extends in the depth direction 30, in the case of an tilted arrangement of the bearing strip 18 with respect to the depth direction of course as viewed in the extension direction of the bearing strips 18.

This V-profile 34 is usually a bent sheet metal part and has an upper leg 34*a* and a lower leg 34*b*, wherein the V-profile 34 points inwards with the tip 13 of its cross-sectional shape, that is, towards the center of the dispensing shelf 1, and points outwards with its open side.

The upper leg 34*a* has a bent profile with an obtuse angle, so that in the mounted state the free end area of this upper leg 34 extends horizontally up to the crank portion with its cross section, while, due to the crank portion, the area that extends thereat in the direction of the tip 13 drops off obliquely downwards in the direction towards the center of the dispensing shelf 1.

Here, the horizontally extending end area is wider than the width of a front upright profile 41*a* regarded in this front view up to the outer edge of which this free end area of the upper leg 34*a* extends if the fixation appliance 36 that extends downwards from the bottom side of this end area and thus of the upper leg 34*a*, namely a vertically positioned plate-shaped screw lug 36, is screwed on the inwards pointing surface of such an upright profile 41*a*.

In that case, a front stop 8 projects upwards over the top side of the upper leg 34*a* within the remaining distance in the width direction 31 between the inner-side surface of the upright profile 41*a* and the crank portion in the upper leg 34*a*, for placing the temperature-control panel 50.

For this reason, the screw lug 36 that projects forwards beyond the frontal end of the upper leg 34*a* (see FIGS. 3*a* and 3*a*1) and the front stop 8 on the front side of the V-profile 34 can be manufactured as a combined bent sheet metal part, which only has to be welded on preferably at the bottom side of the upper legs 34*a*, as can also be seen in the top view of FIG. 1*b*2.

The fixation appliance 36, in particular in the form of the plate-shaped screw lug 36, usually has no upwards projecting stop part at the rear end of the bearing strip 18, that is, of the V-profile 34, in which it projects backwards beyond the rear end of the V-profile.

The lower leg 34*b* extends in principle obliquely outwards and downwards, but optionally concretely only in its outer end area, since the lower leg 34*b* also has a cranking with an obtuse angle, as a result of which the area between the upper end of the obliquely tilted end area and the tip 13 of the V-profile 34 extends in an approximately horizontal manner.

A light bar 40 is attached at the obliquely tilted end area on the bottom side of the lower leg 34*b*, for which purpose an attachment device 32, e.g. in the form of an aperture, is present at each end of the V-profile 34.

Like in FIG. 1*a*, also in FIG. 1*c*, the base front plate 16 is shown attached as a flap at its upper edge at the height of the lowermost depth profile 41*b* so as to be pivotable via a hinge.

The power supply 43 and control unit 66 for the electrically operated temperature-control panels 50 in a dispensing shelf 1 are accommodated inside the base space 12, as shown in FIGS. 1*a, b, c*.

For this purpose, the cables 64 of the individual temperature-control panels 50 that are guided downwards in the cable channel 29 to the control unit 66 and the power supply 43—and that are dimensioned to be sufficiently long for this purpose—respectively have a plug 65 at their free end.

Either as a separate structural component or at the back side of the power supply unit 43—which in most cases is formed integrally together with the control unit 66—, fitting plug sockets 67*a* to 67*d* are located, into which respectively a plug 65 of an temperature-control panel 50, 50' can be inserted and above all can also be pulled out of it if this temperature-control panel 50, 50' is either to be replaced by another temperature-control panel 50, 50' or another dividing element 6, such as for example a simple bearing shell 6, is to be inserted in its stead in the dispensing shelf 1.

If the control unit 66 and the power supply unit 43 are designed integrally—as shown in FIGS. 1*a*, 1*b*, 1*c*—it is usually mounted in the base space 12 in the upper area at the base frame 19 with a backwards pointing operating unit 66*a* in its front side, as indicated in FIG. 1*a*, in which the necessary display elements and switches as well as controllers are provided, and the plug bar 67 with the individual plug sockets 67*a* to 67*d* is arranged either on the front side of the combined unit 66, 43, as shown in FIG. 1*b*—in that case, however, offset backwards at a sufficient distance from the front side 3 of the base space 12 to facilitate insertion of the plug 65—or on the side surface of the combined unit 66, 43, as shown in FIG. 1*c*.

FIGS. 2*a*, 2*b* further show detailed renderings of the side plates 20, which are indicated in FIG. 1*a* in the upper two levels, in different attachment types in the vertical section:

In FIG. 2*b*, the attachment of the side plate 20 is shown by way of example for one of the compartments, that is, of the levels, of the dispensing shelf 1 at the height between two dividing elements 6 in the form of temperature-control panels 50 which with their lateral support areas 59 rest on bearing strips 18 that are screwed on at the inner surfaces of an upright profile 41*a* in the front and in the back.

Here, the side plate 20 is located in the width area of the front and rear upright profiles 41*a*, and with its front and rear rim is held in its position by means of two clamp parts 39 that in most cases are present in a manner arranged above and at a distance to each other in height and are attached at the upright profile 41*a*, as can be seen in FIG. 1*a*.

In the enlarged view of FIG. 2*b* it can be seen that these can be two individual angular profiles which are attached with one leg at the upright profile 41*a* and with the other two facing legs clamp in the side plate 20 in between them, for example.

The side plates 20 can also have holes through which a screw connection with respect to the at least one angle profile can be realized, which, however, is to be avoided in order to avoid contamination-relevant rims and individual parts.

Thus, the side plate 20—in most cases formed as a translucent side panel 20—is fixated in an immovable manner between the front and the rear upright profiles 41*a*, and also substantially fills the height distance between the temperature-control panels 50 located above and below it.

This solution will be chosen if the storage space 2 is at the same time the removal space 4, that is, if the products P are taken out from the front side, for example in the case that a single dispensing shelf is set up.

In contrast, FIG. 2*a* shows a solution in which a removal space 4—preferably accommodated in a further dispensing shelf 1—is located laterally next to the inner space that is only used as a storage space 2 in the compartment of a dispensing shelf 1.

In that case, a reach back protection device 9 is present between the two spaces 2, 4, so that the removing person 100 has to first push the product P that is placed in the storage space 2 on the temperature-control panel 50 to take it out by means of a tool 37, such as for example a slider 33 (see also FIG. 1*a*), which substantially extends through the closed front side 3, namely has to first push it from the storage space 2 into an adjoining removal space 4 onto a dividing element 6 present there—which does not need to be heated—to then be able to reach into the removal space 4 from the front side and take out the desired product from the same.

To avoid that the product is pushed back from the removal space 4 into the storage space 2, the side plate 20 is arranged as a reach back protection device 9 between the frontal and rear upright profile 41*a* in a manner to be pivotable about a pivot axis 49 that usually extends horizontally. As viewed in the front view of FIG. 2*a*, the pivot axis 49 is located laterally outside the side plate 20 and is mounted in a pivotable manner in a fitting hat profile that is attached, for example in an adhesive manner, at the rear and front end of the side plate 20 on the outer side of the same.

The pivot axis 49 projects respectively in the direction of the central area of the side plate 20 from a base plate 72 that extends vertically in the width direction in front and behind the front and rear end of the side plate 20 and is arranged at respectively one of the facing outer surfaces of one of the upright profiles 41*a*.

This base plate 72 forms a suspension device 10 together with a carrier pin 73 that projects from the upright profile 41*a* in the direction towards the other front or rear upright profile 41*a* in the depth direction 30. The suspension device 10 may comprise, for example, a hooking device.

For this purpose, the base plate 72 has an L-shaped recess 74 that opens into one of its side edges and that is dimensioned in such a manner that the unit consisting of side plate 20 and base plates 72 that are attached thereat in the front and in the back can be suspended on the front and rear carrier pin 73 at the front and rear upright profile 41*a* by the two base plates 72 being respectively pushed over a carrier pin 73 with the orifice of their L-shaped recess until the carrier pin 73 rests in the upwards pointing closed end of the L-shaped recess 74.

Here, the carrier pin 73 is still located in the height area of the side plate 20, and since also the carrier pin 73 as well as the pivot axis 49 are located on the outer side of the side plate 20 (as viewed in the depth direction) with respect to the center of the dispensing shelf 1, the carrier pin 73 acts as a stop for the upper end of the side plate 20 located above the pivot axis 49 if the side plate 20 is pivoted about the pivot axis 49.

Thus, the suspended part of the side plate 20 located below the pivot axis 49 can be pivoted in the direction of the storage space 2 only by a small angle, namely until its upper area touches the carrier pin 73, which of course has to extend in the depth direction 30 up into the depth area of the side plate 20.

However, this small pivotation of the side plate 20 is not sufficient to push a product that is already present in the removal space 4 back into the storage space 2, or to reach from the removal space 4 into the storage space 2 with the hand.

However, in contrast to that, the side plate 20 can be pivoted to an unlimited degree, that is, also up to a horizontal position, in the other direction, that is, with the lower end of the side plate 20 in the direction towards the removal space 4, so that the product P can be easily pushed under it into the removal space 4, also pushing the side plate 20 in front of it until it is pivoted back over the product P into its vertically suspended start position.

However, this pivotability of the side plate 20 with the lower area outwards with respect to the dispensing shelf has a second important function when it comes to temperature-control panels 50 as dividing elements 6:

For, due to the non-heated lateral edge area 53, these temperature-control panels 50 reach all the way up to or to close to the outer edge of the base frame and thus of the upright profiles 41*a*.

For taking out the temperature-control panels 50 backwards from the base frame 19, they accordingly have to be positioned obliquely at first, so that they can be passed in between the rear upright profiles 41*a*.

But since the perpendicularly positioned or suspended side plate 20 is located in the width area of the upright profile 41*a* in the normal state, and thus in the width direction 31 above of the [lateral] edge area of the temperature-control panel 50, it is only possible if the lower area of the side plate can be pivoted outwards so far with respect to the dispensing shelf 1 that the edge area of the temperature-control panel 50 located below it can be pivoted upwards past the pivoted side plate 20 into the oblique position that is necessary for taking out the temperature-control panel 50 backwards, as shown in FIG. 2*a* by a dashed line.

PARTS LIST

1 dispensing shelf
2 storage space
2' storage area
3 front side of the storage space

4 removal space
5 removal opening
6 bearing shell, dividing element, compartment base
7 rear stop
8 front stop
9 reach back protection device
10 suspension device
11 disc, storage front plate
12 base space
12' base area
13 tip
14 tool opening
15 rear door
16 base front plate
17 cross bar
18 bearing strip
19 frame, base frame
20 side plate
21 hinge
22 back side
23 price tag holder
24 price tag
25 closing damper
26 magnet
27 stop damper
28 price tag unit
29 cable channel
30 depth direction
31 width direction, transversal direction
32 attachment device
33 spoon, slider
34 V-profile
34*a* upper leg
34*b* lower leg
35 stop
36 fixation appliance, screw lug
37 tool
38 offset distance
39 clamp part
40 light bar
41 profile
41*a* upright profile
41*b* depth profile
41*c* cross profile
42 cover plate
43 power supply unit
44 vertical line
45 latch
46 recess
47 plate pivot axis
48 latch mechanism
49 pivot axis
50 temperature-control panel
51 composite plate
51.1 front edge
51.2/3 side edge
51.4 rear edge
51' main plane
51*a* top plate
51*b* bottom plate
52*a, b* temperature-control area
53 non-heated edge area
54 heated edge area
55 core area
56 temperature-control layer
56*a* heating wire, electrically conductive element
57 temperature sensor
58 support area
59 protective coating, stainless steel plate
60 insulating layer
61 rear bar
62 gripping bar
63 corner recess
64 cable
65 plug
66 control unit
66*a* operating unit
67 socket connector
67*a, b* plug socket
68 adhesive layer
69 cover strip
70 rear profile
71 cable duct
72 base plate
73 carrier pin
74 recess
100 removing person
101 hand
200 base surface
D thickness
P product

The invention claimed is:

1. A self-service dispensing shelf for storing, presenting and dispensing food products, which are to be hygienically protected, to a removing person, comprising:

a base frame having front upright profiles and rear upright profiles, at least one storage space for storing and presenting products on a respective shelf, so that the products are visible to the removing person, a front side arranged to face towards the removing person, a back side arranged to face away from the removing person, a right side and a left side as seen in a depth direction from the front side to the back side, at least one removal space for taking out the products from the dispensing shelf, wherein the at least one storage space comprises multiple storage spaces or the at least one removal space comprises multiple removal spaces, and wherein the multiple storage spaces or the multiple removal spaces are at least partially arranged one above the other in levels, which are separated from each other in height by a shelf arranged between them as a dividing element, between the front upright profiles and the rear upright profiles of the base frame there are support strips running along the left and right sides of the dispensing shelf for supporting the shelves, at least one shelf is embodied as a temperature-control panel, sides of the base frame are partially closed by multiple side plates, the side plates on each level are arranged to each be pivotable outwardly about a pivot axis extending in the depth direction, so that lower edges of the side plates can be pivoted outwardly in order to be able to lift a side edge of the temperature-control panel and pass the temperature-control panel upwards for removal in an inclined state, wherein one of the side plates is arranged as a pivotable reach back protection device, and the dispensing shelf includes a suspension device for attaching the reach back protection device so that the reach back protection device is pivotably limited.

2. The dispensing shelf according to claim 1, wherein each shelf that separates adjacent removal spaces of the multiple removal spaces or adjacent storage spaces of the multiple storage spaces is embodied as a temperature-control panel.

3. The dispensing shelf according to claim 1, wherein when the temperature-control panel is placed centrally in the dispensing shelf on the support strips extending in the depth direction, the temperature-control panel rests on the support strips up to a lateral overhang of a top side of the support strips of less than 8 mm but does not laterally project beyond dimensions of the base frame.

4. The dispensing shelf according to claim 1, wherein one of the support strips, as viewed in an extension direction, comprises a V-profile which in a mounted state is open towards an outer side of the dispensing shelf, and a fixation appliance for attaching at an upright profile is present at a front end and a rear end of the V-profile, each fixation appliance respectively projecting beyond the V-profile, wherein each fixation appliance comprises a plate-shaped screw lug with a passage opening, wherein a plane of the plate-shaped screw lug extends at a right angle to a free ending area of an upper leg of the V-profile, and the plate-shaped screw lug is offset backwards from a free outer end of the upper leg by an offset distance that maximally corresponds to a width of an upright profile, as viewed from the front side.

5. The dispensing shelf according to claim 1, wherein the temperature-control panel comprises a composite plate, and a data/power cable leads out of a rear narrow side of the composite plate of the temperature-control panel.

6. The dispensing shelf according to claim 1, wherein open areas on at least one of the sides of the base frame are closed by at least one side plate by at least 70%.

7. The dispensing shelf according to claim 1, wherein the reach back protection device is arranged between a storage space of the at least one storage space and a removal space of another dispensing shelf when the another dispensing shelf is located next to the dispensing shelf so that the storage space and the removal space are arranged laterally next to each other, and wherein the reach back protection device comprises a planar material that closes a side of an air space of the storage space by at least 70%.

8. The dispensing shelf according to claim 1, wherein the back side of the dispensing shelf is at least partially closed by a rear door which is translucent at least from the outside of the dispensing shelf to inside of the dispensing shelf.

9. The dispensing shelf according to claim 1, wherein the dispensing shelf has a cover plate that closes a top side of an uppermost storage space and that comprises a thermally insulating material or is mirror-coated, as viewed from a bottom side.

10. The dispensing shelf according to claim 1, wherein the front side of the dispensing shelf is inclined at least in an upper area towards a vertical line with a lower portion of the front side in the upper area being further away from the back side than an upper portion of the front side in the upper area.

11. The dispensing shelf according to claim 1, wherein a suspended cross bar is present between the front upright profiles of the base frame, and is arranged at such a height position that the cross bar is positioned in front of or below a front narrow side of one of the dividing elements.

12. The dispensing shelf according to claim 1, wherein the at least one storage space comprises the at least one removal space.

13. The dispensing shelf according to claim 1, wherein the shelves are arranged one above the other, and inclination of the shelves increases from a lowermost shelf to an uppermost shelf.

14. The dispensing shelf according to claim 1, wherein at least one front stop for the temperature-control panel is present at the base frame.

15. The dispensing shelf according to claim 4, wherein the upper leg of the V-profile, as viewed in the extension direction of the V-profile, extends in a straight manner from its free end up to a rounded tip of the V-profile over a distance that at least corresponds to a width of an upright profile, as viewed from the front side.

16. The dispensing shelf according to claim 4, wherein a lower leg of the V-profile, at least in a section of a free end area of the lower leg, extends obliquely outwards with respect to the upper leg at an angle of 20-60° relative to the free ending area of the upper leg (34 *a*) that extends in a straight manner.

17. The dispensing shelf according to claim 16, wherein in the section of the lower leg that extends obliquely outwards, at least at each end of the one support strip, an attachment device for attaching a light bar at an outer side of the lower leg is present.

18. The dispensing shelf according to claim 4, wherein a front stop, which comprises a same material as the V-profile, projects upward beyond an upper side of the upper leg at the front end of the V-profile.

19. A self-service dispensing shelf assembly for storing, presenting and dispensing food products, which are to be hygienically protected, to a removing person, the dispensing shelf assembly comprising:

a base frame having a front side arranged to face towards the removing person, a back side arranged to face away from the removing person, a right side and a left side as seen in a depth direction from the front side to the back side, a front upright profile, a rear upright profile, and support strips between the front upright profile and the rear upright profile;

multiple shelves that are supported by the support strips and that define multiple storage spaces of the dispensing shelf assembly, each shelf being configured to store and present products so that the products are visible to the removing person, wherein the multiple storage spaces are at least partially arranged one above the other in levels, and at least one of the shelves is embodied as a temperature-control panel; and multiple side plates that at least partially close open spaces on the right and left sides of the base frame, wherein the multiple side plates include a side plate on each level that is arranged to be pivotable outwardly about a pivot axis extending in the depth direction so that a lower edge of the side plate can be pivoted outwardly, wherein one of the multiple side plates is arranged as a pivotable reach back protection device that is pivotably limited so that the one side plate is pivotable to a greater extent in a first direction from a suspended start position as compared to in a second direction opposite the first direction.

20. The dispensing shelf assembly according to claim 19, wherein at least one of the storage spaces comprises a removal space for taking products from the dispensing shelf assembly.

* * * * *